United States Patent [19]

Barth

[11] Patent Number: 4,580,302

[45] Date of Patent: Apr. 8, 1986

[54] PAINTING TOOL

[76] Inventor: James G. Barth, 33 Clinton St., Sea Cliff, N.Y. 11579

[21] Appl. No.: 660,060

[22] Filed: Oct. 12, 1984

[51] Int. Cl.[4] ..... B67B 7/44

[52] U.S. Cl. ..... 7/152; 7/105; 81/3.09; 81/3.55; 30/366

[58] Field of Search ..... 7/105, 151, 152, 156; 81/3.07, 3.09, 3.55, 3.57, 3.47, 3.48; 30/366, 361, 411, 443, 445, 449

[56] References Cited

U.S. PATENT DOCUMENTS

| | | | |
|---|---|---|---|
| 1,453,956 | 5/1923 | Smith | 7/151 |
| 2,521,629 | 9/1950 | Byers | 7/151 |
| 2,858,721 | 11/1958 | Horne, Jr. | 7/152 |
| 2,861,337 | 11/1958 | Behlau | 7/152 |
| 3,204,907 | 9/1965 | Tattrie | 7/105 |
| 3,751,743 | 8/1973 | Buck | 7/152 |
| 3,757,368 | 9/1973 | Thompson | 7/152 |

FOREIGN PATENT DOCUMENTS

| | | | |
|---|---|---|---|
| 259487 | 10/1926 | United Kingdom | 7/152 |

*Primary Examiner*—Roscoe V. Parker
*Attorney, Agent, or Firm*—Michael I. Kroll

[57] ABSTRACT

A tool for a paint can is provided and consists of an elongated shank extending from a handle that has a first structure thereon to remove the paint can lid, a second structure thereon to punch a hole in the paint can gutter so that paint will drain back into the paint can and a third structure thereon to replace the paint can lid by leverage.

3 Claims, 5 Drawing Figures

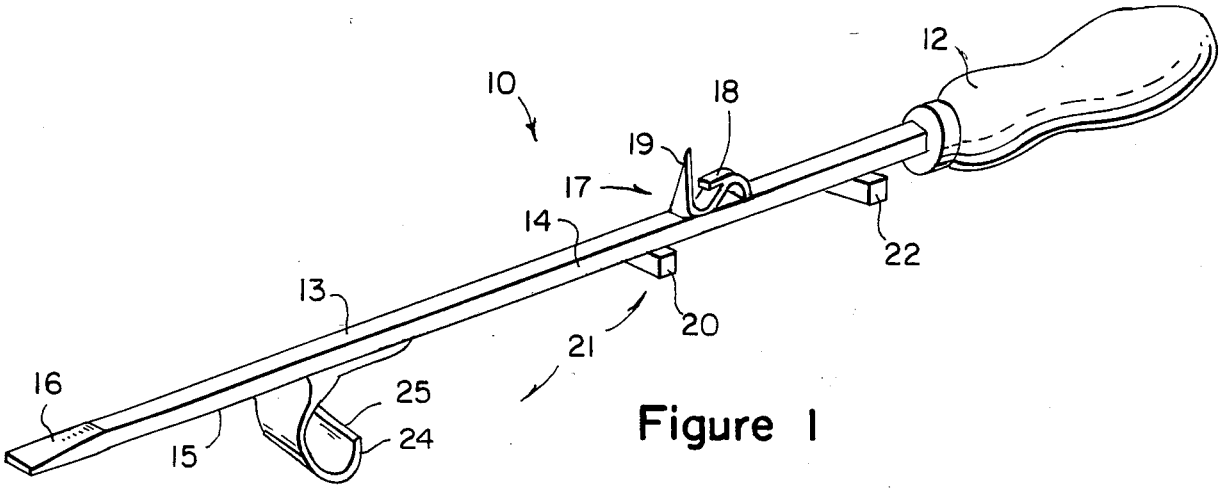
Figure 1
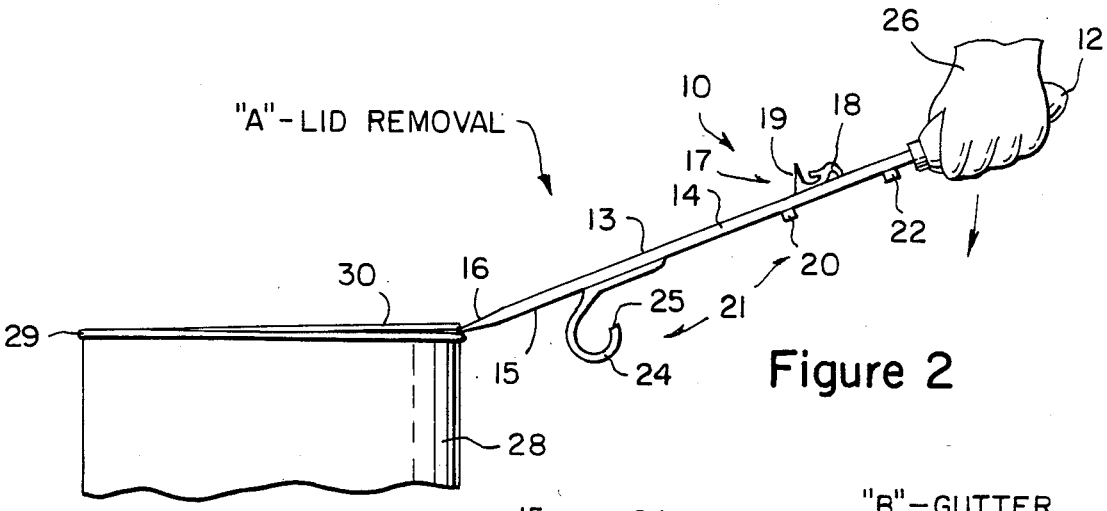
Figure 2
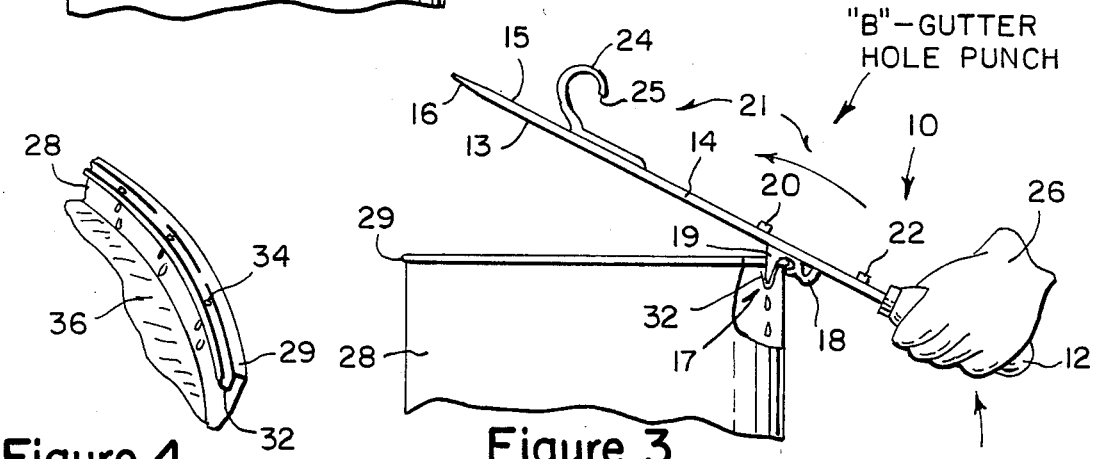
Figure 4
Figure 3
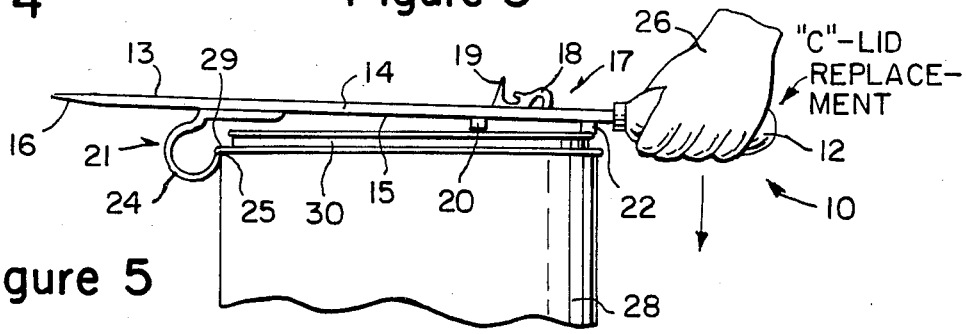
Figure 5

PAINTING TOOL

BACKGROUND OF THE INVENTION

1. Field of Invention

The instant invention relates generally to tools and more specifically it relates to a tool for a paint can.

2. Description of the Prior Art

Numerous tools have been provided in prior art that are adapted to perform different types of functions. While these prior art units may be suitable for the particular purpose to which they address, they would not be suitable for the purposes of the present invention as heretofore described.

SUMMARY OF THE INVENTION

A principle object of the present invention is to provide a tool for a paint can that will remove the paint can lid and punch holes in the gutter so that the paint will drain back into the can preventing a mess while painting thus allowing for a clean lid replacement.

Another object is to provide a tool for a paint can that will replace the paint can lid by leverage without hammering thus eliminating splattering of the paint.

An additional object is to provide a tool for a paint can that is fabricated out of durable materials to be used over a long period of time.

A further object is to provide a tool for a paint can that is simple and easy to use.

A still further object is to provide a tool for a paint can that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the tool.

FIG. 2 is a side view showing the tool removing a lid off a paint can.

FIG. 3 is a side view showing the tool punching a hole in the gutter of the paint can.

FIG. 4 is a partial perspective view of the gutter of the paint can having drain holes punched therein.

FIG. 5 is a side view showing the tool replacing the lid on the paint can.

DETAILED DESCRIPTION OF THE PREFERRED EMBODIMENT

Turning now descriptively to the drawings, in which similar reference characters denote similar elements throughout the several views, FIGS. 1, 2, 3 and 5 illustrate a tool 10 for a paint can 28 that has a rim 29, a gutter 32 and a lid 30. The tool 10 has a handle 12 which can be held in a hand 26 of a user of the tool. An elongated shank 14 extends from the handle 12. The shank 14 has a flat tip 16 on free end for removing the lid 30 from the gutter 32 of the paint can 28 as shown as "A" in FIG. 2.

A structure 17 is provided for punching a hole 34 in the gutter 32 as shown as "B" in FIG. 3. The paint 36 will drain back into the paint can 28 preventing a mess while painting (see FIG. 4). Another structure 21 is also provided for replacing the lid 30 by leverage into the gutter 32 of the paint can 28 without hammering thus eliminating splattering of the paint 36 as shown as "C" in FIG. 5.

The structure 17 for punching a hole 34 in the gutter has a lance-form 18 mounted on one side 13 of the elongated shank 14 near the handle to engage the rim 29 of the paint can. A piercer 19 extends outwardly from the lance-form 18 to punch a hole 34 in the gutter 32 (see FIG. 3).

The structure 21 for replacing the lid 30 by leverage has a C-shaped clamp member 24 mounted on opposite side 15 of the elongated shank 14 near the flat tip 16 to engage the rim 29 of the paint can 28 at edge 25. A first transverse contact member 22 is mounted on the opposite side 15 of the elongated shank 14 near the handle 12 to engage top of the lid 30 to press down the lid into the gutter 32 of the paint can 28 when the paint can 28 is of a gallon size. A second transverse contact member 20 is mounted on the opposite side 15 of the elongated shank 14 between the C-shaped clamp member 24 and the first transverse contact member 22 to engage top of the lid 30 to press down the lid into the gutter 32 of the paint can 28 when the paint can is of a quart size.

The elongated shank 14 is square shaped in cross section to provide flat surfaces so that the lance-form 18 and the piercer 19 can be easily mounted such as by welding or the like on side 13 of the elongated shank. The C-shaped clamp 24, the first transverse contact member 22 and the second transverse contact member 20 can be easily mounted such as by welding or the like on the opposite side 15 of the elongated shank 14. The first transverse contact member 22 and the second transverse contact member 20 are square shaped in cross section to provide flat surfaces so that they can be easily mounted on the square elongated shank 14.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A tool for a paint can having a rim, a gutter and a lid, said tool comprising:

(a) a handle to be held in a hand of a user of said tool;

(b) an elongated shank extending from said handle, said shank having a flat tip on the free end for removing said lid from said gutter of said paint can;

(c) means for punching a hole in said gutter so that paint will drain back into said paint can preventing a mess while painting, said punching means including a lance-form mounted on one side of said elongated shank near said handle to engage said rim of said paint can and a piercer extending outwardly from said lance-form to punch a hole in said gutter; and (d) means for replacing said lid by leverage into said gutter of said paint can without hammering thus eliminating splattering of said paint, said replacing means including a C-shaped clamp member mounted on the opposite side of said elongated shank near said flat tip to engage said rim of said paint can, and a first transverse contact member mounted on said opposite side of said elongated shank near said handle to engage the top of said lid to press down said lid into said gutter of said paint can when said paint can is of a gallon size, and a second transverse contact member mounted on said opposite side of said elongated shank between said C-shaped clamp member and said first transverse contact member to engage the top of said lid to press down said lid into said gutter of said paint can when said paint can is of a quart size.

2. A tool as recited in claim 1, wherein said elongated shank is square shaped in cross section to provide flat surfaces so that said lance-form and said piercer can be easily mounted on said one side of said elongated shank while said C-shaped clamp, said first transverse contact member and said second transverse contact member can be easily mounted on said opposite side of said elongated shank.

3. A tool as recited in claim 2, wherein said first transverse contact member and said second transverse contact member are square shaped in cross section to provide flat surfaces so that they can be easily mounted on said square elongated shank.

* * * * *